US011361613B2

(12) United States Patent
Thomas et al.

(10) Patent No.: US 11,361,613 B2
(45) Date of Patent: Jun. 14, 2022

(54) SKILL STOP FALLING ELEMENT GAME

(71) Applicant: Benchmark Games International, LLC, Lake Worth, FL (US)

(72) Inventors: Michael Scott Thomas, Lake Worth, FL (US); Paul Bastien, Lantana, FL (US)

(73) Assignee: Benchmark Games International, LLC, Lake Worth Beach, FL (US)

( * ) Notice: Subject to any disclaimer, the term of this patent is extended or adjusted under 35 U.S.C. 154(b) by 0 days.

(21) Appl. No.: 17/023,064

(22) Filed: Sep. 16, 2020

(65) Prior Publication Data

US 2021/0082239 A1 Mar. 18, 2021

Related U.S. Application Data

(60) Provisional application No. 62/900,795, filed on Sep. 16, 2019.

(51) Int. Cl.
*G07F 17/32* (2006.01)
*G07F 17/42* (2006.01)

(52) U.S. Cl.
CPC ..... *G07F 17/3216* (2013.01); *G07F 17/323* (2013.01); *G07F 17/3209* (2013.01); *G07F 17/3213* (2013.01); *G07F 17/3244* (2013.01); *G07F 17/3262* (2013.01); *G07F 17/42* (2013.01)

(58) Field of Classification Search
CPC ..... G07F 17/3213; G07F 17/3262; G07F 17/3297; G07F 17/3216
See application file for complete search history.

(56) References Cited

U.S. PATENT DOCUMENTS

| | | | | |
|---|---|---|---|---|
| 8,715,085 | B2 * | 5/2014 | Crowder, Jr. | G07F 17/3244 463/42 |
| 2005/0272498 | A1 * | 12/2005 | Seelig | G07F 17/32 463/16 |
| 2007/0057451 | A1 * | 3/2007 | Halliburton | G07F 17/3297 273/138.1 |
| 2009/0075716 | A1 * | 3/2009 | Seelig | G07F 17/3202 463/20 |
| 2017/0236382 | A1 * | 8/2017 | Colvin | G07F 17/3295 463/17 |

* cited by examiner

*Primary Examiner* — David L Lewis
*Assistant Examiner* — Robert E Mosser

(57) ABSTRACT

An amusement game wherein a pointer element attached to a vertically oriented rail is raised to the top of the rail and released by a latch and allowed to fall. A player is provided with a controller that sends a signal to stop the pointer element as it falls from the top of the rail and the player tries to stop the travel of the pointer so it aligns with a selected target region. If the player successfully stops the pointer within a designated target area, a corresponding score is awarded. In embodiments, the location of pointer is detected by an optical sensor and encoder bar, and the system to stop the fall of the pointer includes an electromagnet attached to the pointer. In embodiments, after play, the pointer assembly is returned to the top of the rail by a drive belt that is powered by an electric motor.

12 Claims, 5 Drawing Sheets

SKILL STOP FALLING ELEMENT GAME

REFERENCE TO RELATED APPLICATIONS

The applicants claim the benefit of the filing date of U.S. No. 62/900,795 filed Sep. 16, 2019.

FIELD OF THE INVENTION

The present invention is directed to amusement games and particularly amusement games for arcades and family fun centers.

SUMMARY OF EMBODIMENTS OF THE INVENTION

The present invention is directed to an amusement game that includes an upright vertical rail on which a designator in the form a pointer assembly is attached to allow for axial motion along its length. To play the game, the pointer is positioned at the top of the vertical rail and, after a countdown, the pointer assembly is released and will freely fall along the vertical rail toward a lower end. A player is provided with a "STOP" pushbutton switch, and, during play, upon of the manipulation of the switch, an electromagnet is activated on the pointer assembly that causes the assembly to adhere to the rail and interrupt the fall and stop vertical movement. A sensor detects the location of the pointer or pointer assembly using an encoder and, when it has stopped, correlates its position with the score that is displayed on the adjacent LCD monitor. The LCD monitor displays a plurality of regions each having different award values, and a prize is awarded in response to the location. The location of the regions and the corresponding values associated with the regions are altered in subsequent iterations of play.

Accordingly, the premise and object of the game is to stop the falling pointer assembly so that its pointer designator is directly adjacent to the highest designated scoring region displayed on the adjacent LCD monitor. In embodiments, smaller regions will have higher values. The progression of the game starts with the detection of a game credit. If there are sufficient credits the activation of the switch starts the pointer assembly release countdown timer. When the countdown reaches zero, a solenoid is activated that releases the assembly from a position at the top of the vertical rail and the assembly freely falls downward in response to gravity. An encoder is provided along the enough which detects the position of the assembly as its travels down the rail and sends a signal to a processor. When the is electromagnet is activated, the location of the pointer is determined from the encoder data, and the processor correlates the location with the regions on the visual display. The processor next assigns the value corresponding to the location, and sends a signal to a visual display, which may include and LED scoreboard and other lights. In embodiments the processor may also send a signal to a loudspeaker to activate the play of a prerecorded audio recording track. In embodiments, a further signal is transmitted to an award dispenser such as a ticket dispenser or magnetic card crediting device. As the countdown progresses, the player is provided with both visual and audible signals, and when the countdown reaches zero, a solenoid is activated that release the assembly from a position at or near the top of the vertical rail. The player tries to time the activation of the STOP button switch so that the pointer stops in the region that's designated as a bonus area. In the event that the player misses the bonus area, the player is awarded the number of tickets or points that are shown in the area in which the pointer stops. In an embodiment, ten zones or regions with different ticket values are provided. The zones or regions with higher ticket values are narrower than the ones with lower ticket values thus making them more difficult to hit. In embodiments, after each play, the Bonus zone presents itself in a different location on the game field for the next play. In further embodiments, the rail on which the travels can be positioned at a steep angle rather than vertical. In yet further embodiments, the rail may have a spiral shape and designator travelling down the rail may spin around the rail or rod as it travels downward.

DETAILED DESCRIPTION

Figure 1:
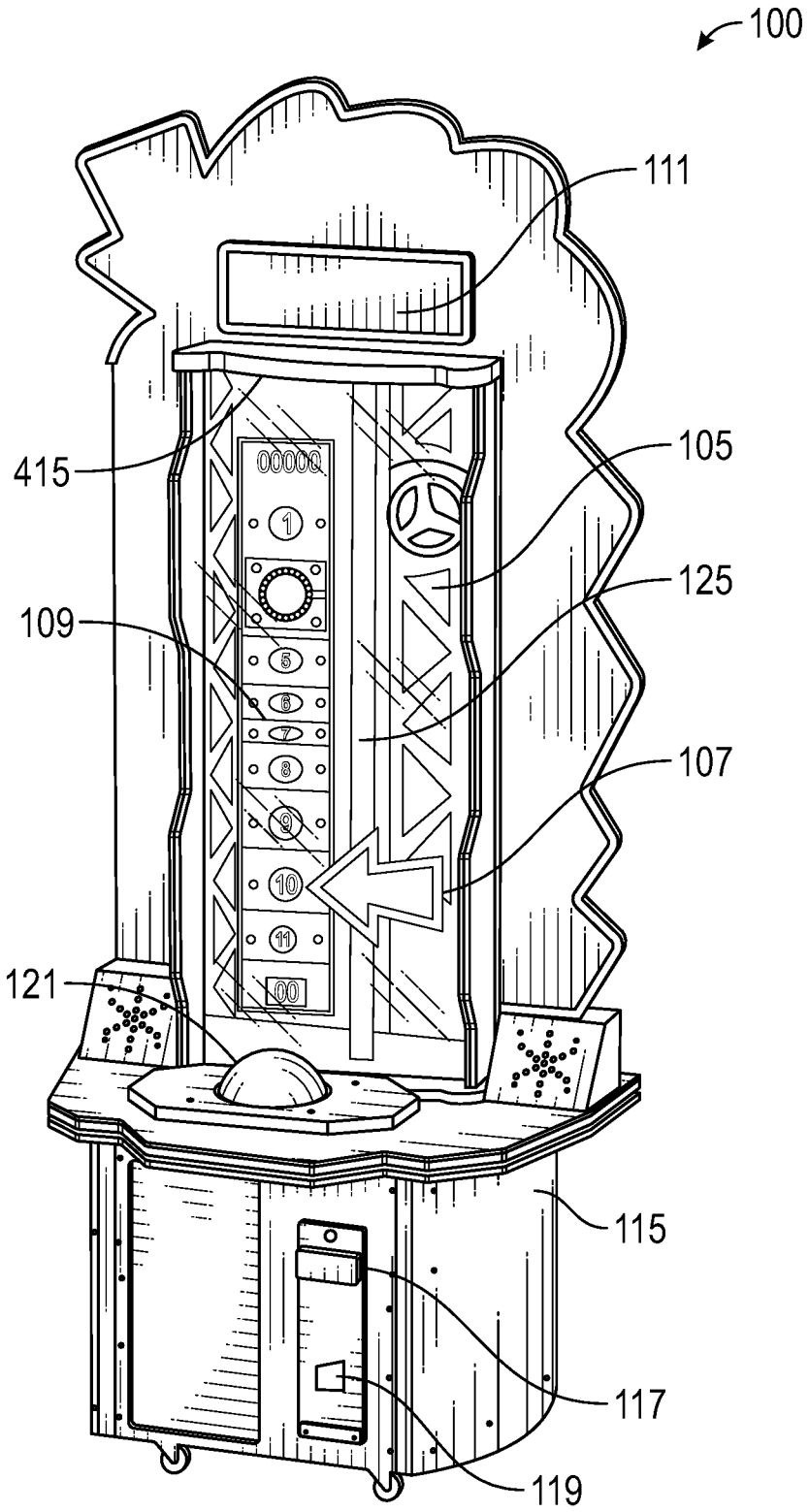
FIG. 1 is a front perspective view of an embodiment of the invention.

Now referring to FIG. 1, a first embodiment of the invention is characterized by a unit 100 that includes upper cabinet region 105 that encloses a pointer designator element 107 mounted on vertical rod or rail 125 and which is attached and configured to allow for vertical rectilinear motion. Adjacent to the rail 125 is target display 109 that includes a plurality of target polygonal regions or segments, stacked on top of each other, many of which have different vertical dimensions. At the top of cabinet 105 there is second display 11 that can provide information about a player's score or game status. The enclosed cabinet is attached to base unit 115 that includes a credit detector 117 and a dispenser 119. In a first embodiment dispenser 119 is a ticket dispenser. In alternative embodiments, other prizes may be dispensed by the unit. The top of base unit 115 has a push button switch 121 that allows the player to provide input to play the game.

Figure 2:
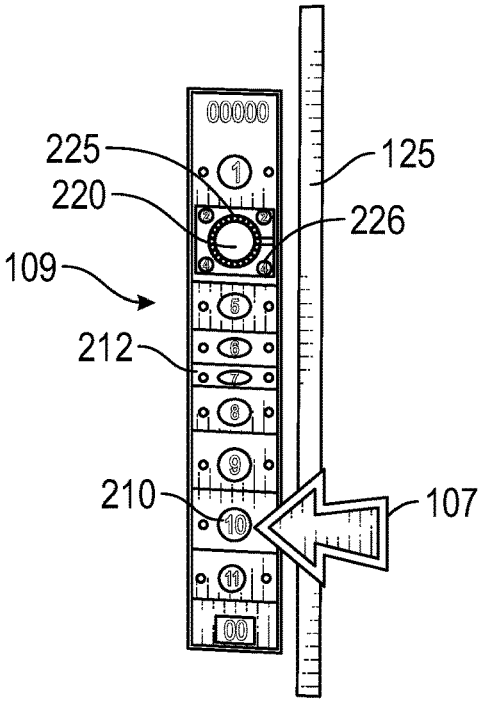
FIG. 2 is a front view in elevation of the vertically oriented rail and pointer assembly next to the elongate target display.

Referring now to FIG. 2, designator pointer element 107 is shown adjacent to target display 109 at a region 210 that has a value of 10. Designator pointer is attached to vertically oriented rail 125 using an assembly in a manner that allows it to substantially freely fall along the rail 125 when released from the top of rail 125. The display 109 has a series of other target regions, wherein the adjacent target regions have different colors and values. For example, display 109 provides region 212 that has a smaller vertical dimension than region 210 and a point value of 7. It is the object of the game to stop pointer element 197 next to the bonus region 220 which has a small vertical dimension, reflected by horizontal lines in the region. In this embodiment, the regions 225 and 226 that are immediately above and below bonus region 220 have values of 2 and 4 respectfully. In embodiments other distributions of prize regions, with different sizes and awards are provided.

Figure 3:
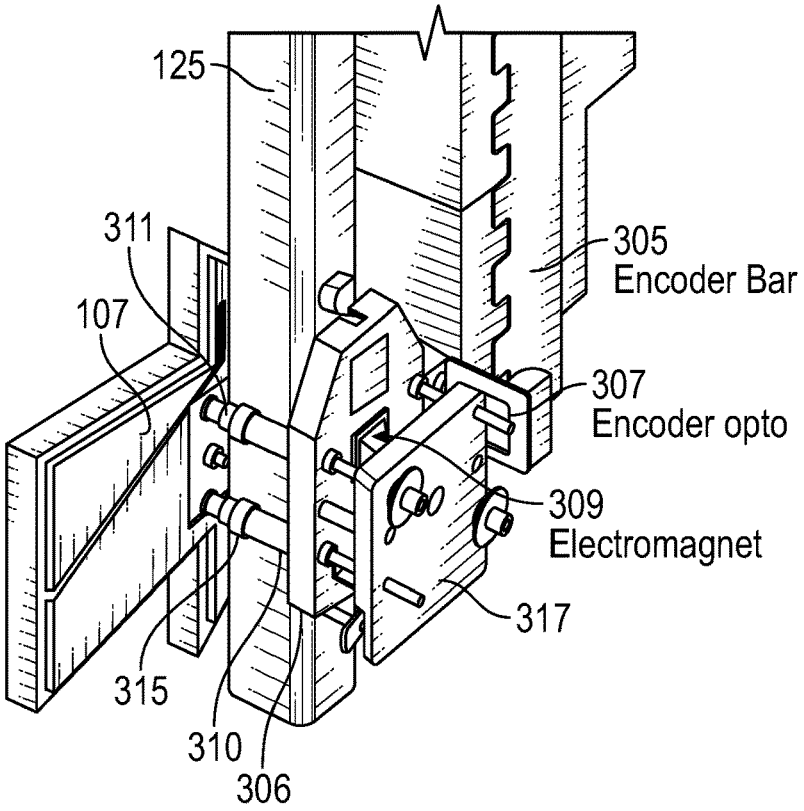
FIG. 3 is a rear perspective view of the pointer assembly and associated adjacent encoder bar.

FIG. 3 depicts a perspective rear view of the designator pointer assembly that includes pointer 107 that is attached to rear plates 306 and second plate 317 by elongate fasteners 310 and 311. The fasteners include annular rollers, such as roller 315 that spins on element 310 and engages the side surface of vertical rail 125. In the center of rear plate 306 is electromagnet 309 that is positioned opposite the rear surface of vertical rail 125. Attached to second rear plate 317 of the assembly is optical encoder 307, that includes a light source and sensor. As the assembly falls along vertical rail 25, the sensor 307 passes fixed encoder bar 305 and detects the respective position of pointer 107 with respect to the display 109.

Figure 4:
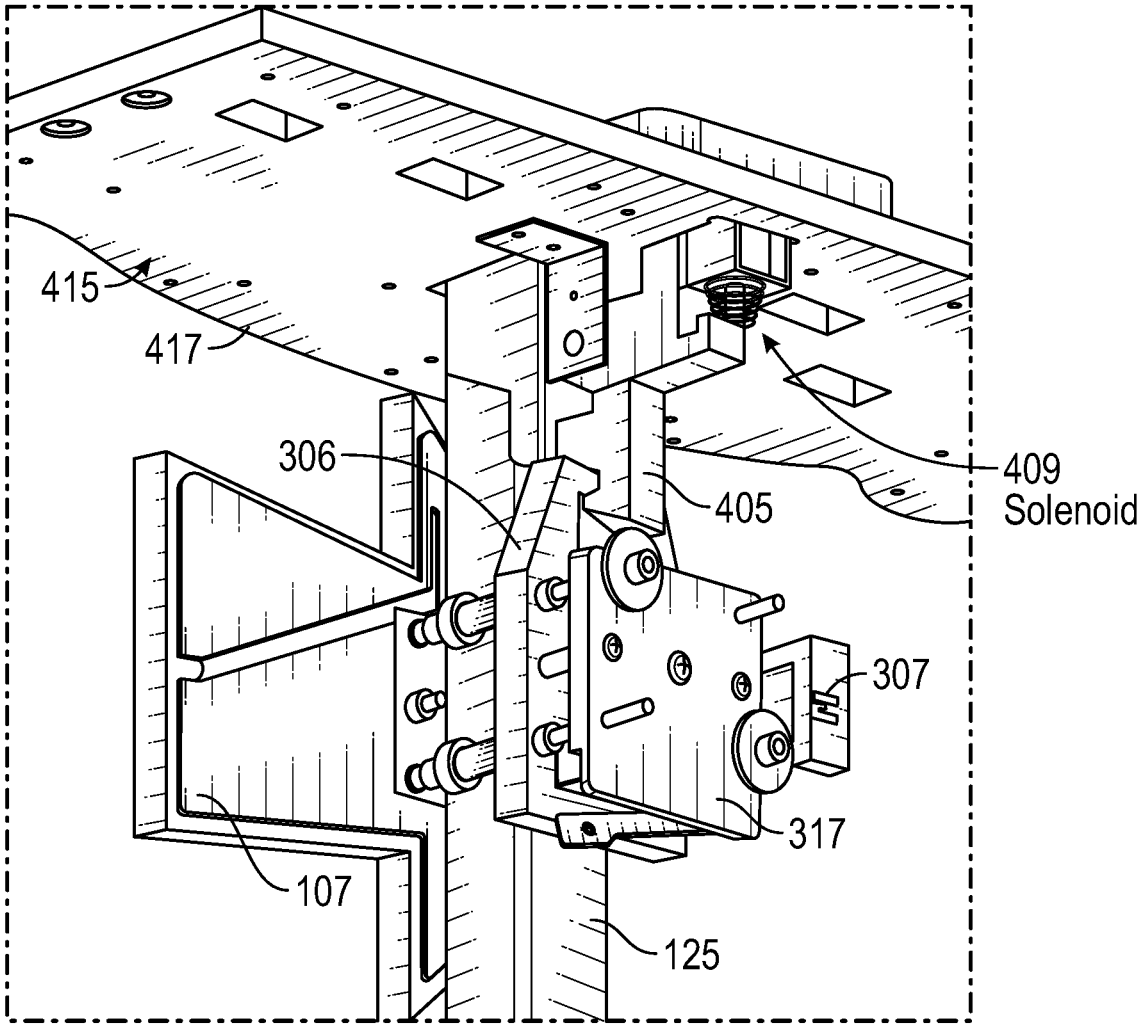
FIG. 4 is a rear perspective view of the pointer assembly in engagement with a retention system that is located at the top of the vertical rail.

Referring now to FIG. 4, the top of vertical bar 125 is attached to lower surface 417 of top plate 415. Also attached to the top plate is release mechanism that includes solenoid 409 and a spring biased latch 405. In response to a signal from a central processor, a piston extends from solenoid 409 to cause the latch 405 to release its engagement with plate 305 and allow the pointer assembly to fall.

After the motion of the assembly and pointer 107 is stopped on vertical rail 125 by activation of electromagnet 309 that causes engagement of the magnet 309 to vertical rail 125, the location of the pointer 107 is determined by a processor using the data from sensor 307 and location is correlated with the score value that is displayed on the adjacent target display 109. Next, the processor sends a signal to deactivate magnet 309 and activate lift motor 505. Lift motor 505 turns pulley 510 attached to lower bracket 540 that drives belt 505 around second pulley 551 that is attached to upper bracket 550. Belt 510 is also attached to one or more lift blocks, such as lift block 517, that engages the pointer assembly, and as the belt is driven, the pointer 107 and its assembly is raised back to the top of the cabinet and engages spring activated latch 405. The latch will pivot in response to the force imposed by the assembly and then snap back to retain rear plate 306 of the pointer assembly. When the assembly has reached the top location, a switch 560 on bracket 550 is activated that reflects that the assembly has returned to a top position and a signal is sent to a processor that in turn, sends a signal to deactivate the lift motor 505. Depending on the game credit status, the controller may also activate the countdown timer and electromagnet control switch. In the embodiment depicted in FIG. 5, optical element 525 activates optical switch 560 located on bracket 550 that will deactivate motor 505. For example, the detection may include an infra-red light source and opposite detector on switch 560 and an optical blocking member on pointer carriage interrupts the light path when the carriage is at the top location. In other embodiments, the pointer assembly engages or triggers a mechanical spring activated switch that sends a signal to the central controller to deactivate motor 505.

Figure 6:
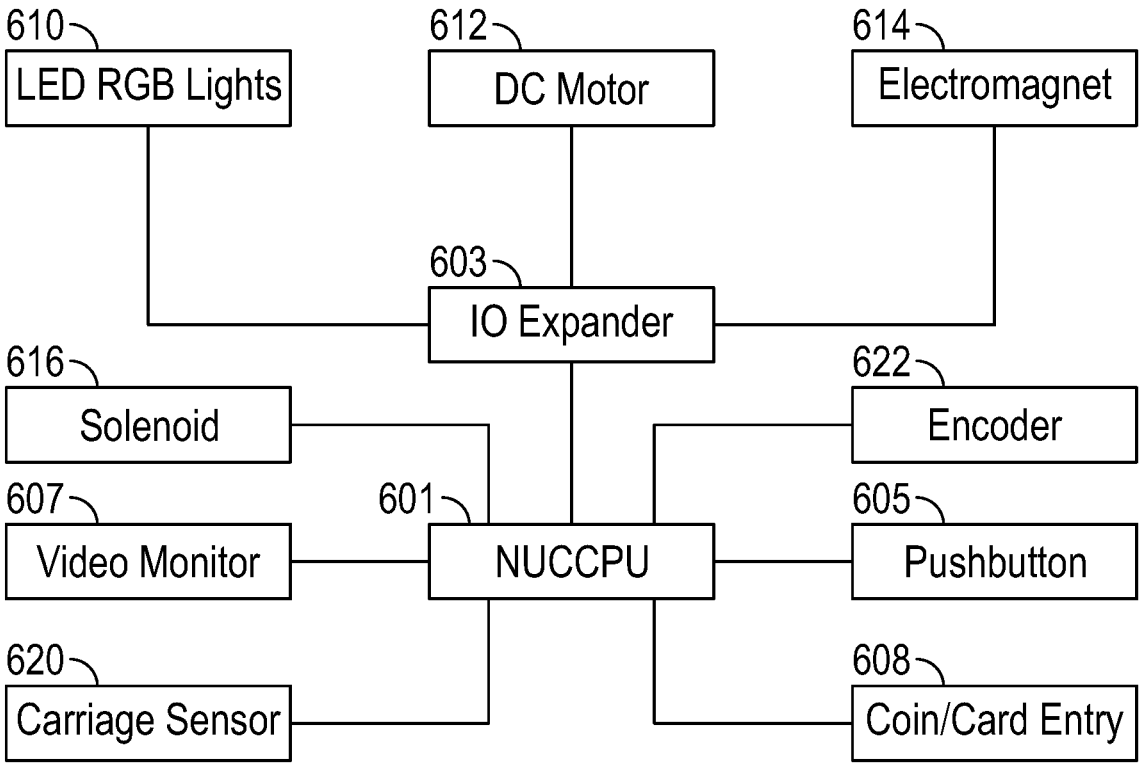
FIG. 6 is a schematic depiction of the input and output signals to the processor.

Referring now to FIG. 6, the electronics of the game include central processor 601, input output expander 603 that sends signals to top score display 610, the DC lift motor 612 and electromagnet 614. An output signal is also sent to solenoid 616 that control the latch which retains the designator pointer 107. In addition, the processor controls video monitor 607 on which the target scores are displayed. The central processor 601 receives input from coin or card acceptor 608 to provide a credit that allows activation of the game. The central processor also received input from pushbutton 605, assembly sensor 620 and encoder 622.

In an embodiment, the operation and game play proceeds as follows: a player provides a credit which will activate pushbutton 605. The first activation of pushbutton initiates play of the game which involves a countdown. In embodiments the countdown is communicated to the player by both an audio signal and using a LED display which count down numbers from a starting point. When the countdown reaches zero, the processor sends a signal to solenoid 616 which releases the assembly that includes the indicator pointer 107 and the assembly falls down the vertical rail from the top of the cabinet.

To stop the motion of the pointer, the button 605 is again depressed, and the processor energizes electromagnet 614 that is also attached to assembly. This causes the assembly and pointer to bind to the steel square rail and stop immediately. The determination of the location of the pointer at any time is accomplished with a limit switch and an IR decoder switch. When the pointer is dropped, the IR sensor beam is broken by tabs that are located at the edges of each zone of the encoder bar. The CPU uses the home switch and the count of tabs that have broken the IR beam to determine the location of the pointer, and which zone it is in.

Figure 5:
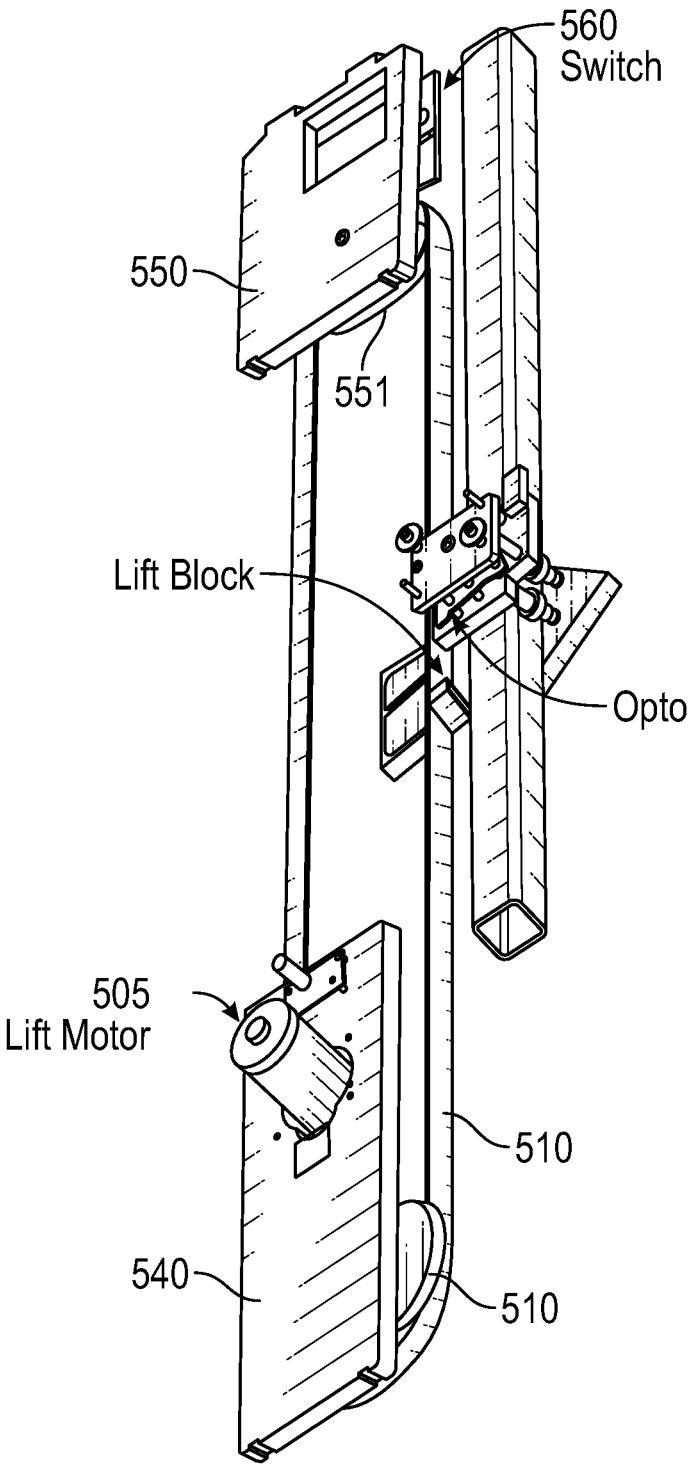
FIG. 5 is a rear perspective view of the lift assembly for the pointer assembly.

In accordance with the game sequence, the processor next correlates the location of the pointer when it stops with the target display, and then displays the number of tickets won on the top display. After a play the pointer pauses for a moment and provides an audible response and visual show from the processor. In this regard pointer 107 in this embodiment is provide with lighting elements. The pointer 107 is then returned to the topmost position of the rail, ready for the next play. This travel is affected by activation of the lift motor 505 as illustrated in FIG. 5 and designation 612 in FIG. 6, and the assembly is returned to the top of the cabinet, and a new target arrangement is displayed on the target display/video monitor 607. When the assembly is detected at the top of the cabinet by sensor 620, a second countdown is initiated, and pushbutton switch 605 is again activated to control the electromagnet. When the countdown once again reaches zero, the processor 601 again sends a signal to the solenoid to release the pointer assembly. The player again tries to time the depression of the pushbutton 605 to activate the electromagnet so that the pointer will stop directly adjacent to the desired target value displayed on monitor 607.

When all credits have been exhausted, the processor will total the score and award a prize correspond to the score. This prize may be in the form of sending a signal to a ticket dispenser or activating a credit that can be transferred to a card or other item that has a magnetic memory or chip. In other embodiments, a physical prize is dispensed.

While the preferred embodiment use an pointer as a designator, it is contemplated other elements could be used such as bombs, raindrops, fruits, or paratroopers. Even though numerous characteristics and advantages of the embodiment have been set forth in the foregoing description, together with details of the methods and systems and function of the embodiment, the disclosure is illustrative only, and changes may be made in detail, especially in the matters of the options, and arrangements of steps within the principles of the present disclosure to the full extent indicated by the broad general meaning of the terms in which the claims shall be expressed.

We claim:

1. An amusement device comprising;

a vertically oriented rail attached to a support member, a pointer assembly adapted to engage said rail member and adapted for vertical travel along said rail element and further configured to allow said assembly to freely fall along said rail, a retention member assembly, said retention member, located near the top of said rail and adapted to retain and release said pointer assembly, a lift assembly, for lifting said pointer assembly along said rail to a retainer location at said retention member assembly, a stop assembly, said stop assembly comprising a controller to allow a user to selectively cause the travel of said pointer element falling along on said rail to stop, a target array, said target array comprising of a plurality of indicators, said indicators provided at locations perpendicular and adjacent to said rail, a sensor, to detect the location of said pointer assembly, and provide a signal to a controller, wherein said central controller is configured to correlate the position of said pointer assembly with respect to said target array and actuate said controller for said stop assembly and to control the release of said pointer assembly from said retention member assembly.

2. The amusement device recited in claim 1 wherein said pointer element lift system comprises a motor, a drive belt connected to said motor, an engagement element for intermittently engaging said pointer assembly and transferring the motion of said belt to said pointer assembly, a switch to provide a signal to said controller to deactivate said motor when said pointer element is in a retained position near the top of said rail and at least two pulleys attached to said support member that receive said drive belt and define a loop for said drive belt.

3. The amusement device recited in claim 1 wherein said retention system for said pointer element comprises a spring-biased latch and a solenoid, wherein in response to a signal from said central controller, said solenoid is activated to exert pressure against said spring, causing said retention element to be displaced and release the engagement of said latch with said pointer element, and allow said pointer element to drop vertically from said retained position downward along said rail.

4. The amusement device as recited in claim 1 further comprising a ferrous metal part in association with said rail, and wherein said stop assembly comprises an electromagnet attached to said pointer assembly and located in proximity to said ferrous metal part; and a stop control switch that, upon activation of said stop control switch, said electromagnet is activated and said electromagnet engages said ferrous metal part.

5. The amusement device as recited in claim 1 wherein said sensor comprises an optical encoder on said pointer assembly and a vertically positioned encoder bar.

6. The amusement device recited in claim 1 further comprising a target area, said target area comprising a plurality of horizontal segments on or adjacent to said rail.

7. The amusement device recited in claim 6, wherein said target array comprises a LED display located adjacent to said rail.

8. The amusement device recited in claim 7, wherein said display is dynamic and said display is controlled by said controller, wherein the size, location and value of targets of said array are controlled by said central controller.

9. The amusement device recited in claim 1 wherein said support member further supports a scoreboard, wherein said scoreboard is controlled by said central controller and said central controller provides output signals based upon input signals from said pointer sensor and a correlation of stored target locations, and said controller sends a signal to said scoreboard reflecting a value.

10. The amusement device recited in claim 9 further comprising a ticket dispenser, said ticket dispenser controlled by said central controller.

11. The amusement device recited in claim 1 further comprising a payment acceptor, and a credit switch and said acceptor send a signal to a central controller when a valid threshold payment has been detected.

12. The amusement device of claim 1 further comprising a countdown signal device, said countdown signal device configured for communicating a countdown, and at the end of said countdown said controller will send a signal to said retention member to release said pointer member.

* * * * *